US007954430B2

(12) United States Patent
Chretien et al.

(10) Patent No.: US 7,954,430 B2
(45) Date of Patent: Jun. 7, 2011

(54) UNDERSIDE CURING OF RADIATION CURABLE INKS

(75) Inventors: Michelle Nena Chretien, Mississauga (CA); Peter G. Odell, Mississauga (CA); Leonard A. Parker, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 819 days.

(21) Appl. No.: 11/946,502

(22) Filed: Nov. 28, 2007

(65) Prior Publication Data

US 2009/0135239 A1 May 28, 2009

(51) Int. Cl.
*B41F 23/04* (2006.01)

(52) U.S. Cl. ..... 101/424.1; 347/102

(58) Field of Classification Search ..... 347/102; 101/424.1

See application file for complete search history.

(56) References Cited

U.S. PATENT DOCUMENTS

| | | | | |
|---|---|---|---|---|
| 3,655,173 | A * | 4/1972 | Costello | 432/5 |
| 5,180,611 | A * | 1/1993 | Costello | 427/510 |
| 5,212,526 | A * | 5/1993 | Domoto et al. | 430/124.4 |
| 5,764,263 | A * | 6/1998 | Lin | 347/101 |
| 6,258,873 | B1 | 7/2001 | Gundlach et al. | |
| 6,283,589 | B1 | 9/2001 | Gelbart | |
| 6,354,700 | B1 * | 3/2002 | Roth | 347/103 |
| 6,399,173 | B1 | 6/2002 | Nagayama et al. | |
| 6,428,159 | B1 | 8/2002 | Roy et al. | |
| 6,492,458 | B1 | 12/2002 | Pavlin | |
| 6,536,889 | B1 * | 3/2003 | Biegelsen et al. | 347/95 |
| 6,850,261 | B2 * | 2/2005 | Taki et al. | 347/156 |
| 7,009,630 | B1 * | 3/2006 | Finger et al. | 347/212 |
| 7,125,112 | B2 * | 10/2006 | Ushirogouchi et al. | 347/100 |
| 7,202,883 | B2 | 4/2007 | Breton et al. | |
| 7,360,887 | B2 * | 4/2008 | Konno | 347/103 |
| 7,510,277 | B2 * | 3/2009 | Konno et al. | 347/102 |
| 2003/0065084 | A1 | 4/2003 | MacQueen et al. | |
| 2003/0081096 | A1 * | 5/2003 | Young | 347/102 |
| 2004/0114016 | A1 * | 6/2004 | Yokoyama | 347/102 |
| 2004/0223029 | A1 * | 11/2004 | Nishino | 347/33 |
| 2005/0195260 | A1 * | 9/2005 | Figov et al. | 347/102 |
| 2006/0066704 | A1 * | 3/2006 | Nishida | 347/103 |
| 2007/0058021 | A1 * | 3/2007 | Kusunoki | 347/102 |
| 2007/0120921 | A1 | 5/2007 | Carlini et al. | |
| 2007/0120924 | A1 | 5/2007 | Odell et al. | |
| 2007/0120930 | A1 | 5/2007 | Domoto et al. | |
| 2007/0188575 | A1 * | 8/2007 | Nakazawa | 347/102 |
| 2007/0296790 | A1 * | 12/2007 | Nakazawa et al. | 347/102 |
| 2008/0231646 | A1 * | 9/2008 | Sugahara | 347/6 |

FOREIGN PATENT DOCUMENTS

| | | | |
|---|---|---|---|
| JP | 57102355 | A * | 6/1982 |
| JP | 03254945 | A * | 11/1991 |

OTHER PUBLICATIONS

"Dimer Acids," Kirk-Othmer Encyclopedia of Chemical Technology, vol. 8, 4th Ed. (1992), pp. 223-237.

* cited by examiner

*Primary Examiner* — Matthew Luu
*Assistant Examiner* — Rut Patel
(74) *Attorney, Agent, or Firm* — Oliff & Berridge, PLC

(57) ABSTRACT

An ink printing device is disclosed that incorporates a curing lamp located on the opposite side of a printed face of a printed substrate and partially cures a radiation curable ink by irradiating through the substrate. Additionally, this disclosure provides a method for partially curing radiation curable inks by exposing a radiation curable ink on a substrate to a curing lamp located opposite the printed face of the substrate.

17 Claims, 2 Drawing Sheets

UNDERSIDE CURING OF RADIATION CURABLE INKS

TECHNICAL FIELD

This disclosure is generally directed to ink printing devices that include curing of radiation curable inks, and a method for partially curing radiation curable inks. In particular, this disclosure provides an ink printing device incorporating a curing lamp that is located on the opposite side of a printed face of a printed substrate and partially cures a radiation curable ink by irradiating through the substrate, prior to a subsequent, or simultaneous with, a complete curing of the ink. Additionally, this disclosure provides a method for partially curing radiation curable inks by exposing a radiation curable ink on a substrate to a curing lamp located opposite the printed face of the substrate.

BACKGROUND

Ink printing devices, such as ink-jet printers or offset printing presses, are known to incorporate curing lamps in order to cure known radiation curable inks, for example an ultra-violet (UV) curing lamp to cure a UV curable ink.

In such ink printing devices, a radiation curable ink is printed onto a substrate, such as paper, and then is cured by a curing lamp. The curing lamp cures substantially all of the ink by shining directly onto it. The substrate is generally moved throughout the device, from the location of the print head to the location of the curing lamp, by one or more rollers, belts, or the like.

Unfortunately, between when the ink is deposited by the print head and when it is cured by the curing lamp, the uncured ink can bleed into the substrate. For example, a liquid or molten uncured ink can bleed into the fibers of a paper substrate and can become at least partially visible from the backside of the substrate. This problem is known in the art as showthrough or strike-through, and is generally known to exist for any type of liquid ink deposited on a porous substrate. This issue is more pronounced in inks of low viscosity, such as ink jet inks, while higher viscosity inks such as litho inks are less susceptible to this problem. Specifically, showthrough is a measure of how colorized an ink makes the backside of the substrate.

A drawback of backside showthrough is the inability to do duplex printing. Particularly, when the ink wicks towards the opposite side of the paper, two-sided printing would not be possible, because the ink that shows-through to the opposite side could ruin the second print, or degrade the quality of print on both sides of the paper. Complete passage of the ink through the paper is not necessary for show through to be noticeable, even a small distance of travel into the paper may evoke a detectable difference compared to an ink that remains entirely on the surface.

The problem of showthrough is conventionally addressed in one or more of several known ways. First, showthrough can be minimized by controlling physical properties of the ink by, for example, controlling its viscosity as disclosed in U.S. Pat. No. 6,258,873, or by controlling its drying time as discussed in U.S. Pat. No. 6,428,159. Showthrough may also be minimized by coating the substrate with various polymers, such as is disclosed in U.S. Pat. No. 6,283,589. Known methods of varying ink composition and substrate coatings are the most widely used approaches to minimizing showthrough.

However, these approaches suffer from several disadvantages. For example, the ink composition and the substrate coating generally must be chemically compatible in order for showthough to be minimized. Specifically, ink composition properties such as drying time, viscosity, surface energy and polarity must be specifically tailored to match certain substrate coating properties such as porosity, ionic charge and hydrophobicity in order to result in decreased showthrough. In this way, either the ink or the surface coating often must be reformulated in order to work with the other, a situation that can preclude using other desired combinations of ink and substrate stock.

Other methods of minimizing showthrough are known. For instance, showthrough may be controlled by subjecting the printed image to fusing by applying to the image a fusing member at an elevated temperature, as disclosed in U.S. Pat. No. 7,202,883. Finally, commonly assigned U.S. Pat. No. 6,428,159 describes an ink printing apparatus that prevents showthrough by including a drying system that allows for rapidly evaporating water from an ink, while the ink is still resident on the paper surface. However, these approaches to dealing with showthrough suffer from disadvantages of requiring complicated machinery and being energy intensive, and thus lacking wide commercial viability. Furthermore, these approaches are not particularly suited to radiation curable inks, only for thermo-curable and evaporative inks respectively.

Therefore, there is a need for an apparatus and method for efficiently minimizing showthrough of a radiation curable ink on a substrate, which has wide applicability to various radiation curable inks and substrates.

SUMMARY

The present disclosure addresses these and other needs, by providing an ink printing device incorporating a curing lamp that is located on the opposite side of a printed face of a printed substrate and partially cures a radiation curable ink immediately following printing by irradiating through the substrate. Additionally, this disclosure provides a method for partially curing radiation curable inks by exposing a radiation curable ink on a substrate to a curing lamp located opposite the printed face of the substrate.

In embodiments, this disclosure provides an ink printing device that includes a print head for printing a radiation curable ink, one or more rollers for moving a substrate through the device, a first curing lamp located opposite a printed face of a printed substrate and a second curing lamp located on the same side as the printed face of the printed substrate. In further embodiments, this disclosure provides a method for forming a printed substrate that includes printing a radiation curable ink onto a substrate, partially curing the underside of the ink immediately after printing by irradiating the backside of the printed substrate with a first curing lamp, and substantially fully curing the ink by irradiating the front side of the printed substrate with a second curing lamp.

DETAILED DESCRIPTION OF EMBODIMENTS

Figure 1A:
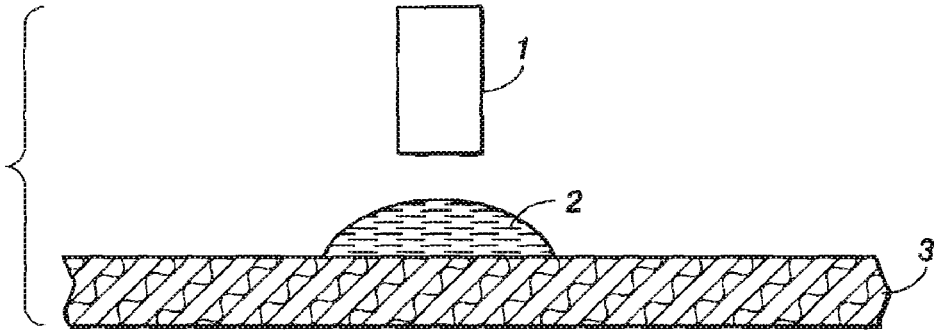
FIG. 1A is a cross-sectional view that shows an ink which has been placed onto a substrate by a print head.

This disclosure is not limited to particular embodiments described herein, and some components and processes may be varied by one of ordinary skill in the art, based on this disclosure. The terminology used herein is for the purpose of describing particular embodiments only, and is not intended to be limiting.

In this specification and the claims that follow, singular forms such as "a," "an," and "the" include plural forms unless the content clearly dictates otherwise. In addition, reference may be made to a number of terms that shall be defined as follows:

The phrase "radiation curable ink" means any colorless, colorized, white, or black ink composition that contains monomers that polymerize when the ink composition is exposed to a certain wavelength of the electro-magnetic spectrum.

The phrase "drop spreading" means the process by which individual drops of ink spread out across the surface of a substrate in order to form a continuous coating.

The phrase "UV light" means ultra-violet electromagnetic radiation in the spectrum of wavelengths between about 1 and about 400 nanometers. The phrase "UVA" refers to ultra-violet electromagnetic radiation in the spectrum of wavelengths between about 320 and about 400 nanometers, while the phrase "UVB" refers to ultra-violet electromagnetic radiation in the spectrum of wavelengths between about 280 and about 320 nanometers.

An improved ink printing device for printing a radiation curable ink on a substrate comprises a curing lamp located on the opposite side of a printed face of a printed substrate that partially cures a radiation curable ink immediately following printing by irradiating through the substrate.

The ink printing device as a whole may be any known device for printing inks, such as an ink-jet printer, for example a piezoelectric ink jet, thermal ink jet, acoustic ink jet; an offset printing press, a flexographic printing press, or a lithographic printing press.

The radiation curable ink may be any known colorless, color, white or black, ink that cures under radiation. For example, the radiation curable ink may be an ultra-violet (UV) curable ink. Ink compositions according to this disclosure generally include a carrier, a colorant, and one or more additional additives. Such additives can include, for example, solvents, waxes, antioxidants, tackifiers, slip aids, curable components such as curable monomers and/or polymers, gellants, initiators, sensitizers, humectants, biocides, preservatives, and the like. Specific types and amounts of components will depend, of course, on the specific type of ink composition, such as liquid, solid, hot melt, phase change, gel, or the like. The curable ink may be a carrier for functional particles such as conductive or magnetic particles.

Generally, the ink compositions contain one or more colorant. Any desired or effective colorant can be employed in the ink compositions, including pigment, dye, mixtures of pigment and dye, mixtures of pigments, mixtures of dyes, and the like.

The colorant can be present in the ink composition in any desired or effective amount to obtain the desired color or hue. For example, the colorant can typically be present in an amount of at least about 0.1 percent by weight of the ink, such as at least about 0.2 percent by weight of the ink or at least about 0.5 percent by weight of the ink, and typically no more than about 50 percent by weight of the ink, such as no more than about 20 percent by weight of the ink or no more than about 10 percent by weight of the ink, although the amount can be outside of these ranges.

The ink compositions can also optionally contain an antioxidant. The optional antioxidants of the ink compositions protect the images from oxidation and also protect the ink components from oxidation during the heating portion of the ink preparation process. Specific examples of suitable antioxidants include NAUGUARD® series of antioxidants, such as NAUGUARD® 445, NAUGUARD® 524, and NAUGUARD® 76 (commercially available from Uniroyal Chemical Company, Oxford, Conn.), the IRGANOX® series of antioxidants such as IRGANOX® 1010 (commercially available from Ciba Geigy), and the like. When present, the optional antioxidant can be present in the ink in any desired or effective amount, such as in an amount of from at least about 0.01 to about 20 percent by weight of the ink, such as about 0.1 to about 5 percent by weight of the ink, or from about 1 to about 3 percent by weight of the ink, although the amount can be outside of these ranges.

The ink compositions can also optionally contain a viscosity modifier. Examples of suitable viscosity modifiers include aliphatic ketones, such as stearone, and the like. When present, the optional viscosity modifier can be present in the ink in any desired or effective amount, such as about 0.1 to about 99 percent by weight of the ink, such as about 1 to about 30 percent by weight of the ink, or about 10 to about 15 percent by weight of the ink, although the amount can be outside of these ranges.

As a radiation, such as ultraviolet light, curable ink composition, the ink composition comprises a carrier material that is typically a curable monomer, curable oligomer, or curable polymer, or a mixture thereof. The curable materials are typically liquid at 25° C. The curable ink composition can further include other curable materials, such as a curable wax or the like, in addition to the colorant and other additives described above.

The term "curable" refers, for example, to the component or combination being polymerizable, that is, a material that may be cured via polymerization, including for example free radical routes, and/or in which polymerization is photoinitiated though use of a radiation sensitive photoinitiator. Thus, for example, the term "radiation curable" is intended to cover all forms of curing upon exposure to a radiation source, including light and heat sources and including in the presence or absence of initiators. Example radiation curing routes include, but are not limited to, curing using ultraviolet (UV) light, for example having a wavelength of 200-400 nm or more rarely, visible light, such as in the presence of photoinitiators and/or sensitizers, curing using e-beam radiation, such as in the absence of photoinitiators, curing using thermal curing, in the presence or absence of high temperature thermal initiators (and which are generally largely inactive at the jetting temperature), and appropriate combinations thereof. The curing process is a polymerization that can procede by a radical or cationic pathway or a combination of both. The initiating species maybe free radical, acidic or basic in nature.

Suitable radiation, such as UV, curable monomers and oligomers include, but are not limited to, acrylated esters, acrylated polyesters, acrylated ethers, acrylated polyethers, acrylated epoxies, urethane acrylates, and pentaerythritol tetraacrylate. In addition, however, non-acrylate curable monomers and oligomers such as vinyl ethers and maleates can be used.

Specific examples of suitable acrylated oligomers include, but are not limited to, acrylated polyester oligomers, such as CN2262 (Sartomer Co.), EB 812 (Cytec Surface Specialties), EB 810 (Cytec Surface Specialties), CN2200 (Sartomer Co.), CN2300 (Sartomer Co.), and the like, acrylated urethane oligomers, such as EB270 (UCB Chemicals), EB 5129 (Cytec Surface Specialties), CN2920 (Sartomer Co.), CN3211 (Sartomer Co.), and the like, and acrylated epoxy oligomers, such as EB 600 (Cytec Surface Specialties), EB 3411 (Cytec Surface Specialties), CN2204 (Sartomer Co.), CN110 (Sartomer Co.), and the like; and pentaerythritol tetraacrylate oligomers, such as SR399LV (Sartomer Co.) and the like. Specific examples of suitable acrylated monomers include, but are not limited to, polyacrylates, such as trimethylol propane triacrylate, pentaerythritol tetraacrylate, pentaerythritol triacrylate, dipentaerythritol pentaacrylate, glycerol propoxy triacrylate, tris(2-hydroxyethyl)isocyanurate triacrylate, pentaacrylate ester, and the like, epoxy acrylates, urethane acrylates, amine acrylates, acrylic acrylates, and the like. Mixtures of two or more materials can also be employed as the reactive monomer. Suitable reactive monomers are commercially available from, for example, Sartomer Co., Inc., Henkel Corp., Radcure Specialties, and the like.

The radiation curable monomer or oligomer variously functions as a viscosity reducer, as a binder when the composition is cured, as an adhesion promoter, and as a crosslinking agent, for example. Suitable monomers can have a low molecular weight, low viscosity, and low surface tension and comprise functional groups that undergo polymerization upon exposure to radiation such as UV light.

In embodiments, the monomer is equipped with one or more curable moieties, including, but not limited to, acrylates; methacrylates; alkenes; allylic ethers; vinyl ethers; epoxides, such as cycloaliphatic epoxides, aliphatic epoxides, and glycidyl epoxides; oxetanes; and the like. Examples of suitable monomers include monoacrylates, diacrylates, and polyfunctional alkoxylated or polyalkoxylated acrylic monomers comprising one or more di- or tri-acrylates. Suitable monoacrylates are, for example, cyclohexyl acrylate, 2-ethoxy ethyl acrylate, 2-methoxy ethyl acrylate, 2-(2-ethoxyethoxy)ethyl acrylate, stearyl acrylate, tetrahydrofurfuryl acrylate, octyl acrylate, lauryl acrylate, behenyl acrylate, 2-phenoxy ethyl acrylate, tertiary butyl acrylate, glycidyl acrylate, isodecyl acrylate, benzyl acrylate, hexyl acrylate, isooctyl acrylate, isobornyl acrylate, butanediol monoacrylate, ethoxylated phenol monoacrylate, oxyethylated phenol acrylate, monomethoxy hexanediol acrylate, beta-carboxy ethyl acrylate, dicyclopentyl acrylate, carbonyl acrylate, octyl decyl acrylate, ethoxylated nonylphenol acrylate, hydroxyethyl acrylate, hydroxyethyl methacrylate, and the like. Suitable polyfunctional alkoxylated or polyalkoxylated acrylates are, for example, alkoxylated, such as ethoxylated or propoxylated, variants of the following: neopentyl glycol diacrylates, butanediol diacrylates, trimethylolpropane triacrylates, glyceryl triacrylates, 1,3-butylene glycol diacrylate, 1,4-butanediol diacrylate, diethylene glycol diacrylate, 1,6-hexanediol diacrylate, tetraethylene glycol diacrylate, triethylene glycol diacrylate, tripropylene glycol diacrylate, polybutanediol diacrylate, polyethylene glycol diacrylate, propoxylated neopentyl glycol diacrylate, ethoxylated neopentyl glycol diacrylate, polybutadiene diacrylate, and the like.

In embodiments, the ink composition includes at least one reactive monomer and/or oligomer. However, other embodiments can include only one or more reactive oligomers, only one or more reactive monomers, or a combination of one or more reactive oligomers and one or more reactive monomers. However, in embodiments, the composition includes at least one reactive (curable) monomer, and optionally one or more additional reactive (curable) monomers and/or one or more reactive (curable) oligomers.

The curable monomer or oligomer in embodiments is included in the ink in an amount of, for example, about 20 to about 90% by weight of the ink, such as about 30 to about 85% by weight of the ink, or about 40 to about 80% by weight of the ink. In embodiments, the curable monomer or oligomer has a viscosity at 25° C. of about 1 to about 50 cP, such as about 1 to about 40 cP or about 10 to about 30 cP. In one embodiment, the curable monomer or oligomer has a viscosity at 25° C. of about 20 cP. Also, in some embodiments, it is desired that the curable monomer or oligomer is not a skin irritant, so that printed images using the ink compositions are not irritable to users.

When a curable wax is included, the curable wax may be any wax component that is miscible with the other components and that will polymerize with the curable monomer or oligomer to form a polymer. The term "wax" includes, for example, any of the various natural, modified natural, and synthetic materials commonly referred to as waxes. A wax is solid at room temperature, specifically at 25° C. In inkjet printing specifically, inclusion of the wax promotes an increase in viscosity of the ink as it cools from the jetting temperature.

Suitable examples of curable waxes include, but are not limited to, those waxes that include or are functionalized with curable groups. The curable groups may include, for example, acrylate, methacrylate, alkene, allylic ether, epoxide, oxetane, and the like. These waxes can be synthesized by the reaction of a wax equipped with a transformable functional group, such as carboxylic acid or hydroxyl.

Suitable examples of hydroxyl-terminated polyethylene waxes that may be functionalized with a curable group include, but are not limited to, mixtures of carbon chains with the structure $CH_3$—$(CH_2)_n$—$CH_2OH$, where there is a mixture of chain lengths, n, where the average chain length can be in the range of about 16 to about 50, and linear low molecular weight polyethylene, of similar average chain length. Suitable examples of such waxes include, but are not limited to, the UNILIN® series of materials such as UNILIN® 350, UNILIN® 425, UNILIN® 550 and UNILIN® 700 with $M_n$ approximately equal to 375, 460, 550 and 700 g/mol, respectively. All of these waxes are commercially available from Baker-Petrolite. Guerbet alcohols, characterized as 2,2-dialkyl-1-ethanols, are also suitable compounds. Exemplary Guerbet alcohols include those containing about 16 to about 36 carbons, many of which are commercially available from Jarchem Industries Inc., Newark, N.J. PRIPOL® 2033 (C-36 dimer diol mixture including isomers of the formula

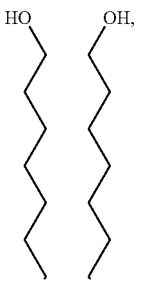

-continued

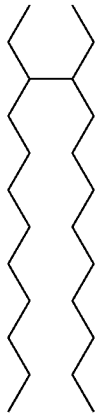

as well as other branched isomers that may include unsaturations and cyclic groups, available from Uniqema, New Castle, Del.; further information on $C_{36}$ dimer diols of this type is disclosed in, for example, "Dimer Acids," *Kirk-Othmer Encyclopedia of Chemical Technology*, Vol. 8, 4$^{th}$ Ed. (1992), pp. 223 to 237, the disclosure of which is totally incorporated herein by reference) can also be used. These alcohols can be reacted with carboxylic acids equipped with UV curable moieties to form reactive esters. Examples of these acids include acrylic and methacrylic acids, available from Sigma-Aldrich Co. In embodiments, suitable curable monomers include waxy acrylates, such as acrylates of UNILIN® 350, UNILIN® 425, UNILIN® 550 and UNILIN® 700.

Suitable examples of carboxylic acid-terminated polyethylene waxes that may be functionalized with a curable group include mixtures of carbon chains with the structure $CH_3$—$(CH_2)_n$—COOH, where there is a mixture of chain lengths, n, where the average chain length is about 16 to about 50, and linear low molecular weight polyethylene, of similar average chain length. Suitable examples of such waxes include, but are not limited to, UNICID® 350, UNICID® 425, UNICID® 550 and UNICID® 700 with $M_n$ equal to approximately 390, 475, 565 and 720 g/mol, respectively. Other suitable waxes have a structure $CH_3$—$(CH_2)_n$—COOH, such as hexadecanoic or palmitic acid with n=14, heptadecanoic or margaric or daturic acid with n=15, octadecanoic or stearic acid with n=16, eicosanoic or arachidic acid with n=18, docosanoic or behenic acid with n=20, tetracosanoic or lignoceric acid with n=22, hexacosanoic or cerotic acid with n=24, heptacosanoic or carboceric acid with n=25, octacosanoic or montanic acid with n=26, triacontanoic or melissic acid with n=28, dotriacontanoic or lacceroic acid with n=30, tritriacontanoic or ceromelissic or psyllic acid, with n=31, tetratriacontanoic or geddic acid with n=32, pentatriacontanoic or ceroplastic acid with n=33. Guerbet acids, characterized as 2,2-dialkyl ethanoic acids, are also suitable compounds. Exemplary Guerbet acids include those containing 16 to 36 carbons, many of which are commercially available from Jarchem Industries Inc., Newark, N.J. PRIPOL® 1009 (C-36 dimer acid mixture including isomers of the formula

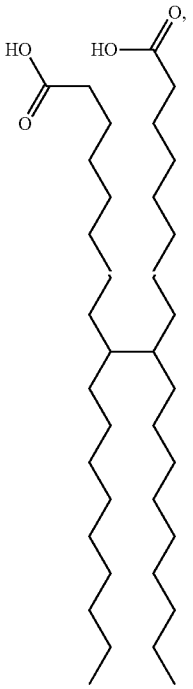

as well as other branched isomers that may include unsaturations and cyclic groups, available from Uniqema, New Castle, Del.; further information on $C_{36}$ dimer acids of this type is disclosed in, for example, "Dimer Acids," *Kirk-Othmer Encyclopedia of Chemical Technology*, Vol. 8, 4$^{th}$ Ed. (1992), pp. 223 to 237, the disclosure of which is totally incorporated herein by reference) can also be used. These carboxylic acids can be reacted with alcohols equipped with UV curable moieties to form reactive esters. Examples of these alcohols include, but are not limited to, 2-allyloxyethanol from Sigma-Aldrich Co.;

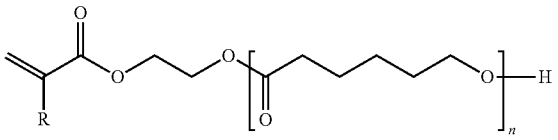

TONE M-101 (R═H, $n_{avg}$=1), TONE M-100 (R═H, $n_{avg}$=2) and TONE M-201 (R=Me, $n_{avg}$=1) from The Dow Chemical Company; and

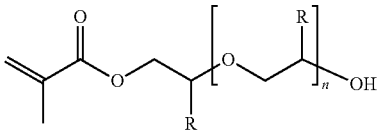

CD572 (R═H, n=10) and SR604 (R=Me, n=4) from Sartomer Company, Inc.

The curable wax can be included in the ink composition in an amount of from, for example, about 1 to about 25% by weight of the ink, such as about 2 or about 5 to about 10 or about 15% by weight of the ink. In an embodiment, the curable wax can be included in the ink composition in an amount of from about 6 to about 10% by weight of the ink, such as about 8 to about 9% by weight of the ink.

Also in embodiments, the composition further comprises an initiator, such as a photoinitiator, that initiates polymerization of curable components of the ink, including the curable monomer and the curable wax. The initiator should be soluble in the composition. In embodiments, the initiator is a UV-activated photoinitiator.

In embodiments, the initiator can be a radical initiator. Examples of suitable radical photoinitiators include ketones such as hydroxycyclohexylphenyl ketones, benzyl ketones, monomeric hydroxyl ketones, polymeric hydroxyl ketones, α-amino ketones, and 4-(2-hydroxyethoxy)phenyl-(2-hydroxy-2-propyl) ketone; benzoins; benzoin alkyl ethers; acyl phosphine oxides, metallocenes, benzophenones, such as 2,4,6-trimethylbenzophenone and 4-methylbenzophenone; trimethylbenzoylphenylphosphine oxides such as 2,4,6-trimethylbenzoyl-diphenyl-phosphine oxide; azo compounds; anthraquinones and substituted anthraquinones, such as, for example, alkyl substituted or halo substituted anthraquinones; other substituted or unsubstituted polynuclear quinines; acetophenones, thioxanthones; ketals; acyiphosphines; thioxanthenones, such as 2-isopropyl-9H-thioxanthen-9-one; mixtures thereof; and the like. One suitable ketone is 1-[4-(2-hydroxyethoxy)-phenyl]-2-hydroxy-2-methyl-1-propane-1-one. In an embodiment, the ink contains an α-amino ketone, 1-[4-(2-hydroxyethoxy)-phenyl]-2-hydroxy-2-methyl-1-propane-1-one and 2-isopropyl-9H-thioxanthen-9-one. In another embodiment, the photoinitiator is one of the following compounds or a mixture thereof: a hydroxycyclohexylphenyl ketone, such as, for example, 1-hydroxycyclohexylphenyl ketone, such as, for example, Irgacure® 184 (Ciba-Geigy Corp., Tarrytown, N.Y.), having the structure:

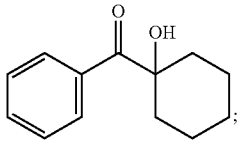

a trimethylbenzoylphenylphosphine oxide, such as, for example, ethyl-2,4,6-trimethylbenzoylphenylphosphinate, such as, for example, Lucirin® TPO-L (BASF Corp.), having the formula

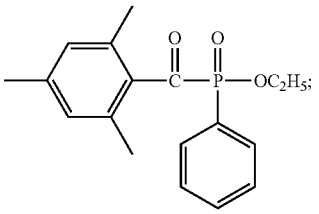

a mixture of 2,4,6-trimethylbenzophenone and 4-methylbenzophenone, such as, for example, SARCURE™ SR 1137 (Sartomer); a mixture of 2,4,6-trimethylbenzoyl-diphenylphosphine oxide and 2-hydroxy-2-methyl-1-phenyl-propan-1-one, such as, for example, DAROCUR® 4265 (Ciba Specialty Chemicals); alpha-amino ketone, such as, for example, IRGACURE® 379 (Ciba Specialty Chemicals); 4-(2-hydroxyethoxy)phenyl-(2-hydroxy-2-propyl) ketone, such as, for example, IRGACURE® 2959 (Ciba Specialty Chemicals); 2-isopropyl-9H-thioxanthen-9-one, such as, for example, DAROCUR® ITX (Ciba Specialty Chemicals); and mixtures thereof.

The total amount of initiator included in the ink may be, for example, about 0.5 to about 15%, such as about 1 to about 10%, by weight of the ink.

The ink may also optionally contain at least one gellant. The gellant can be included, for example, to control the viscosity of the ink composition before and/or after jetting. For example, suitable gellants include a curable gellant comprised of a curable polyamide-epoxy acrylate component and a polyamide component, a curable composite gellant comprised of a curable epoxy resin and a polyamide resin, and the like.

Suitable curable composite gellants include those described in U.S. Pat. Nos. 6,492,458 and 6,399,713, and U.S. Patent Publications Nos. US 2003/0065084, US 2007/0120921, and US 2007/0120924, the entire disclosures of which are incorporated herein by reference. The ink compositions can include the gellant in any suitable amount, such as about 1% to about 50% by weight of the ink. In embodiments, the gellant can be present in an amount of about 2% to about 20% by weight of the ink, such as about 5% to about 15% by weight of the ink, although the value can also be outside of this range.

In the uncured state, the radiation-curable ink composition in embodiments is a low viscous liquid and is readily jettable. For example, in embodiments, the ink has a viscosity of from 8 mPa-s to 15 mPa-s, such as from 10 mPa-s to 12 mPa-s, at a temperature between 60° C. and 100° C. In embodiments, the ink has a viscosity of from $10^5$ to $10^7$ mPa-s at a temperature of 50° C. or below, specifically at a temperature from 0° C. to 50° C. Upon exposure to a suitable source of curing energy, e.g., ultraviolet light, electron beam energy, or the like, the photoinitiator absorbs the energy and sets into motion a reaction that converts the liquid composition into a cured material. The monomer and/or oligomer in the composition contain functional groups that polymerize during exposure to the curing source to readily crosslink forming a polymer network. This polymer network provides printed image with, for example, durability, thermal and light stability, and scratch and smear resistance. Thus, the composition is particularly well-suited for ink-based images printed on substrates that may be subjected to heat or sunlight, because the composition provides a printed image that is resistant to cracking and fading and provides image permanence.

The ink compositions of the present disclosure can be prepared by any desired or suitable method. For example, the ink ingredients can be mixed together, followed by heating, typically to a temperature of from about 60 to about 100° C., although the temperature can be outside of this range, and stirring until a homogeneous ink composition is obtained, followed by cooling the ink to ambient temperature (typically from about 20 to about 25° C.).

The substrate may be any known substrate suitable for ink printing. In accordance with the present disclosure, the substrate should be either translucent or transparent, at least to part or all of the energy outputted by the backside radiation curing lamp. Thus, for example, while the substrate does not need to be completely transparent or translucent, it should be of a type, thickness, porosity, opacity, or the like that allows at least a portion of the curing energy to penetrate through the substrate to reach the applied ink. For example, conventional paper that allows a portion of the curing energy to penetrate the paper can be used. A substrate that is completely opaque will not be able to transmit the curing radiation from the lamp on its one side to the radiation curable ink on its other side. The substrate may be either porous or non-porous.

For example, the substrate may be paper, for example a commercial printing paper stock. Specifically, the substrate may be a Xerox paper stock such as Xerox 4200™, Xerox Eureka™ or Hammermill™ paper. The present disclosure is well suited, for example, to printing on especially thin or porous papers, as these papers would typically experience greater showthrough. A typical porous paper substrate may have different percentage light transmission such as 1% UVC, 10% UVB, 1% UVA and 20% visible. Additionally, the substrate may be, for example, a transparent plastic film, for example a Mylar film.

The first curing lamp may be any known light source that provides sufficient radiation to cure a radiation curable ink. For example, when the ink is a UV curable ink the curing lamp is a UV curing lamp. The curing lamp may use various known technologies as its light source, for example when the curing lamp is a UV curing lamp the light source may be, for example, mercury vapor, mercury arc, Xenon or a light emitting diode.

The intensity of the first curing lamp should be sufficient to partially cure the radiation curable ink, but not enough to entirely cure said ink. Partial curing from underneath creates a "skin" on the underside of the ink droplet, effectively preventing the ink droplet from penetrating the substrate, thereby "pinning" the droplet in place. In this way, the bulk of each ink droplet remains uncured and fluid in order to allow for proper drop spreading before the final curing. For example, the intensity of the radiation transmitted through the substrate can be at least 0.005 $W/cm^2$ and still cure radiation curable inks.

The actual output intensity of the first curing lamp itself depends on various factors within the printing system, for example the degree of radiation transmission of the substrate, the energy required by the ink photoinitiator to initiate polymerization and the speed at which the substrate is fed through the ink printing device. If the lamp output intensity is fixed, any of the foregoing may be varied to achieve the required degree of partial curing of the ink. Alternatively, the lamp output intensity may itself be varied if any of the foregoing factors are fixed.

The first curing lamp is situated such that no, or substantially no, radiation emitted therefrom strikes the print head or ink exiting the print head en route to the print substrate. In embodiments, the first curing lamp is located within the printing device such that the radiation cannot shine on the print head. In a particular embodiment, the first curing lamp is located such that no shielding around the print head is necessary to prevent radiation from the first curing lamp from striking the print head.

The second curing lamp may also be any known light source that provides sufficient radiation to completely cure a radiation curable ink, as described above. The intensity of the second curing lamp should be such that it is sufficient to substantially fully cure the radiation curable ink. The location of the second curing lamp may be either directly opposite the first curing lamp, in which case both sides of the substrate are exposed to the radiation from each lamp simultaneously, or offset from the location of the first lamp, such that the second lamp cures the ink subsequent to the first lamp.

Figure 2:
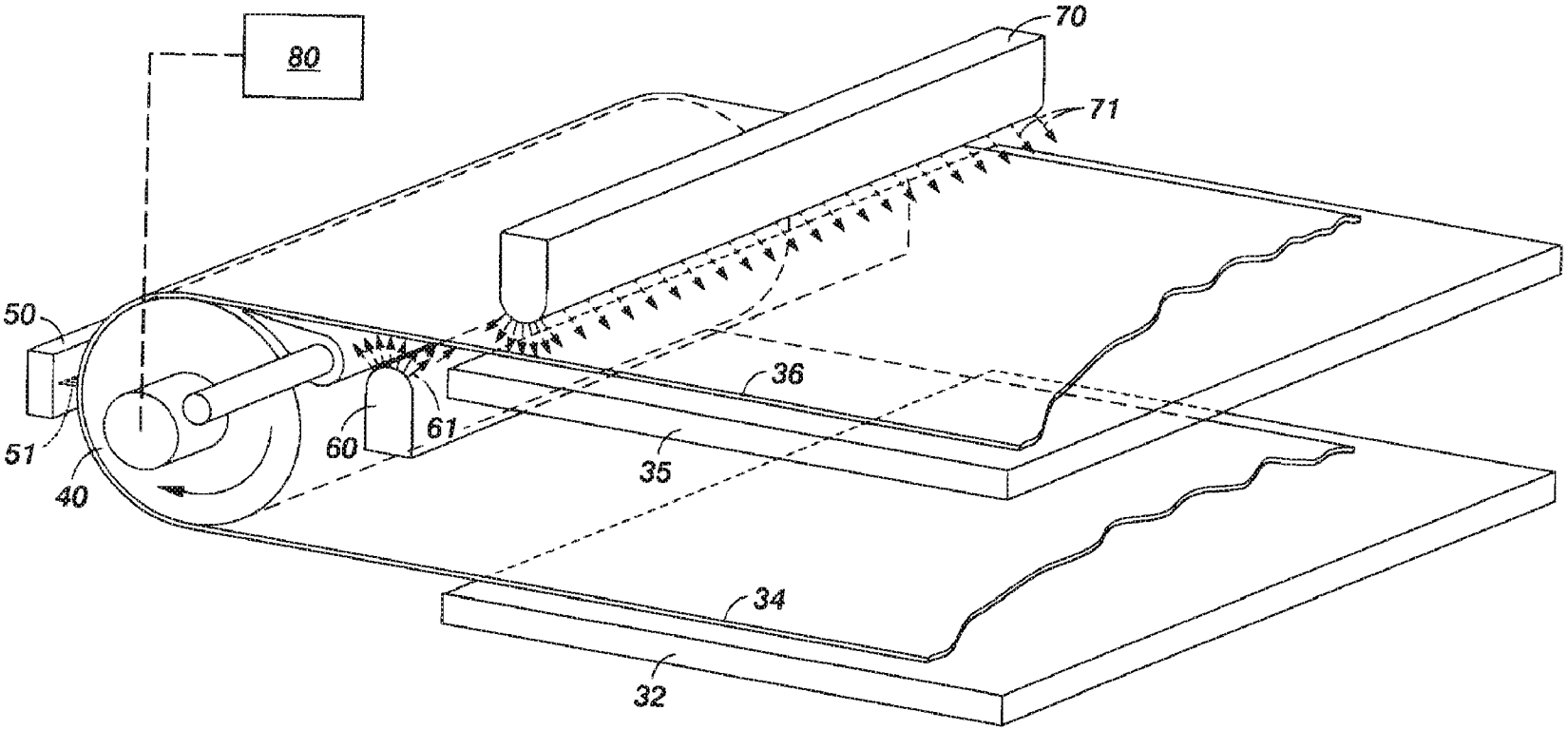
FIG. 2 depicts an ink printer architecture for one embodiment of the disclosure.

FIG. 2 illustrates an embodiment of a printing system implementing the concepts of the present disclosure. Printing system 30 includes an input tray 32 containing a supply of paper 34. The paper is moved out of input tray 32 into engagement with drum 40. Although the particular embodiment illustrated in FIG. 2 uses a drum, the print substrate can also be fed through the printing system via any other mechanism, for example as a sheet or web.

The print head 50 is located exterior to drum 40 in a fashion whereby droplets 51 emitted from the print head are deposited on paper 34. Located within operational distance of drum 40 is a first curing lamp 60 that emits radiation 61 onto the side of paper 34 opposite that which ink was deposited onto by the print head 50. Specifically, as paper 34 is moved by spinning drum 40, the print head 50 jets-ink 51 onto paper 34, which then moves past the first curing lamp 60. Then the paper 34 is moved past and substantially cured by a second curing lamp 70.

An improved method for forming a printed substrate includes printing a radiation curable ink onto a substrate, then partially curing the underside of the ink by irradiating the backside of the printed substrate with a first curing lamp, and substantially fully curing the ink by irradiating the front side of the printed substrate with a second curing lamp.

According to the above method, the partial cure of the underside of the ink may be done immediately after printing. The less time allowed between depositing the ink on the substrate and the partial cure, the less showthrough is likely to develop.

In embodiments, the substantially full curing of the ink may occur at the same time as the partial underside curing. In other embodiments, the substantially full curing may occur subsequently after the partial underside curing.

Figure 1B:
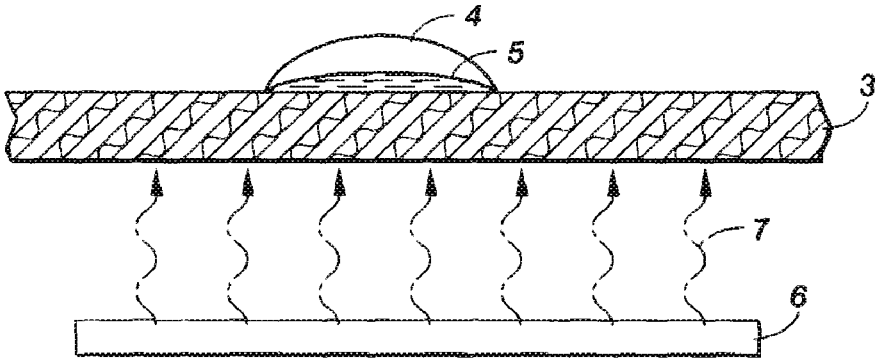
FIG. 1B is a cross-sectional view that shows an ink being exposed to a backside curing lamp.
Figure 1C:
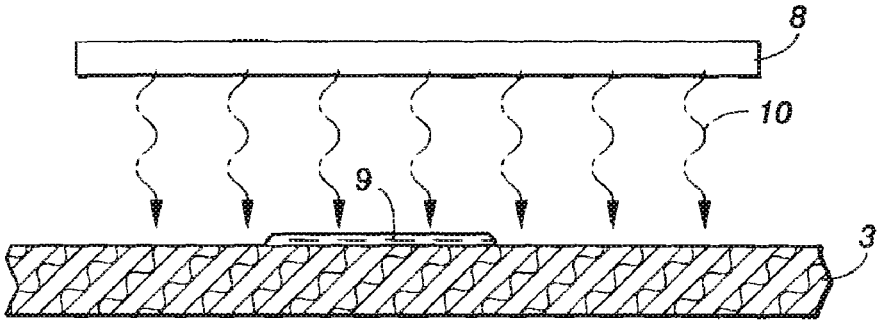
FIG. 1C is a cross-sectional view that shows an ink being exposed to a standard, front side, curing lamp after having been exposed to a backside curing lamp.

FIG. 1 illustrates this process of forming a printed substrate. FIG. 1A shows a droplet of a radiation curable ink 2 being deposited on a substrate 3 by a print head 1. As seen in FIG. 1A, the ink sits atop the substrate immediately after deposition by the print head, but the ink will quickly bleed into the substrate if not further treated. Therefore, the ink droplet is next exposed to backside curing by irradiating the reverse side of the substrate as the printed face with a curing lamp 6 at a specific spectrum and intensity 7 to cause a "skin" 5 to form within the droplet adjacent to the substrate 3. However, the ink droplet is only partially cured by the backside curing lamp, leaving a portion of the droplet 4 uncured. At this point, other action can be taken, such as contact or non-contact spreading of the drop, for example. Finally, the ink droplet is substantially fully cured by a curing lamp 8 by irradiating, at a specific spectrum and intensity 10, the same side as the printed face of the substrate 3. In this way, the ink is allowed to undergo droplet spreading before becoming a fully cured droplet 9.

Specific examples are described in detail below. These examples are intended to be illustrative, and the materials, conditions, and process parameters set forth in these exemplary embodiments are not limiting. All parts and percentages are by weight unless otherwise indicated.

EXAMPLE

Various substrate stocks were place on a conveyor belt and moved past a UV Fusion Mercury curing lamp at a speed of 32 feet per minute. The transmitted light intensity, measured on the opposite side as the lamp in watts per square centimeter, were:

| Sample | Transmitted light intensity W/cm$^2$ | | | |
|---|---|---|---|---|
| | UVC | UVB | UVA | UVV |
| Blank (lamp output) | 0.193 | 1.79 | 1.924 | 1.18 |
| 4200 | 0.002 | 0 | 0.011 | 0.261 |
| Eureka | 0.002 | 0.17 | 0.021 | 0.254 |
| Hammermill | 0.001 | 0 | 0.009 | 0.167 |
| Mylar (uncoated) | 0.009 | 0.01 | 1.654 | 1.037 |

The above shows that sufficient radiation to cure a radiation curable ink passes through various substrates at wavelengths where the ink photoinitiators absorb.

The above substrates were then printed with a Xerox UV-curable ink and exposed to the same conditions as above.

Briefly, the ink contained a gellant comprised of a mixture of:

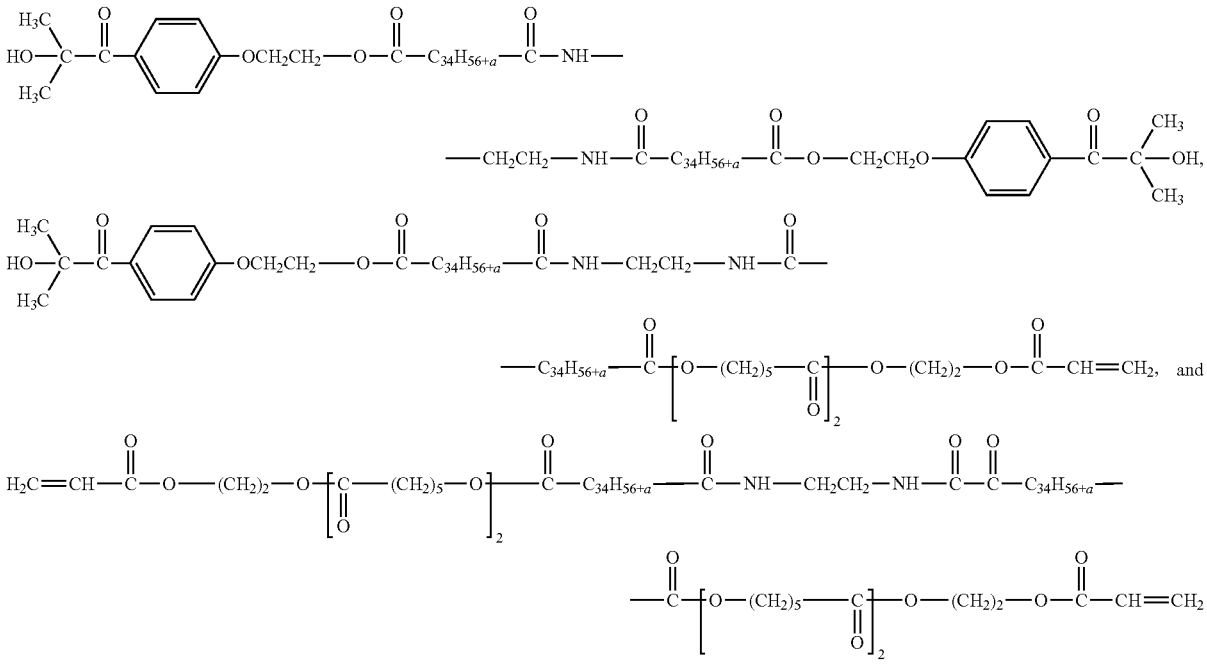

wherein —$C_{34}H_{56+a}$— represents a branched alkylene group which may include unsaturations and cyclic groups, wherein a is an integer of 0, 1, 2, 3, 4, 5, 6, 7, 8, 9, 10, 11, or 12 and wherein mixtures of the first:second:third compounds above are in a molar ratio of about 1:2:1. The UNILIN 350-acrylate wax (optionally prefiltered to 2 μm) was the curable wax. The ink carrier was SR9003, a propoxylated neopentyl glycol diacrylate, reactive monomer. The initiators were Irgacure 379, Darocur ITX, Irgacure 127, and Irgacure 819. The stabilizer was Irgastab UV10. The composition of the ink by weight was 7.5% gellant, 5% curable wax, 5% multifunctional acrylate monomer, 9.5% photoinitiators, 0.2% Irgastab UV 10, 3% pigment with the balance comprised of SR9003. The inks were prepared by mixing the carrier, the wax and the gellant at 90° C. for 2 h, after which time the solutions were filtered to 0.22 μm at 85° C. To these solutions were added the photoinitiator package and stabilizer and the resulting ink base was stirred at 90° C. for 1 h. The resulting solutions were added to a stirring solution of pigment dispersion, also at 90° C., and the resulting ink was stirred for 2 h at 90° C. Nearly complete curing of the image was observed after backside irradiation, demonstrating that the correct choice of radiation source and photoinitiator can enable backside curing on a desired substrate.

In the case of the uncoated Mylar, backside curing resulting in the formation of a cured film of ink at the interface of the substrate, while the bulk of the ink was easily wiped away. This demonstrates the utility of backside curing for pinning ink droplets to transparent, non-porous, substrates in order to achieve the necessary drop spreading prior to the final curing.

It will be appreciated that various of the above-discussed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An ink printing device comprising:

an ink supply for printing a radiation curable ink onto a substrate;

a first radiation curing lamp, located on a side of the substrate opposite that of a printed face of the substrate, which partially cures the radiation curable ink; and a second radiation curing lamp, located on a side of the substrate that is the same as the printed face of the substrate, wherein the ink printing device is an offset printing press.

2. The device of claim 1, wherein the first and second curing lamps are UV curing lamps and the radiation curable ink is a UV curable ink.

3. The device of claim 2, wherein the first and second UV curing lamps are each selected from the group consisting of: a mercury vapor UV curing lamp, a mercury arc UV curing lamp, a Xenon UV curing lamp, and a UV light emitting diode.

4. The device of claim 1, wherein the radiation curable ink comprises:

a radiation curable material, and a colorant.

5. The device of claim 1, wherein the radiation curable material is present in an amount of about 20 to about 90 weight percent, and the colorant is present in an amount of about 0.1 to about 50 weight percent by weight of the ink composition.

6. The device of claim 4, wherein the radiation curable ink is an UV-curable ink.

7. The device of claim 1, wherein an output intensity of the first radiation curing lamp in the UVA or UVB wavelengths delivers at least 0.002 $W/cm^2$ to the printed face of the printed substrate.

8. The device of claim 1, wherein an output intensity of the first radiation curing lamp is at least enough to partially cure the radiation curable ink but not sufficient to substantially fully cure the radiation curable ink.

9. The device of claim 1, wherein an output intensity of the first curing lamp may be manually or automatically changed.

10. A process for forming a substrate printed with a radiation curable ink on an ink printing device, the method comprising:

depositing radiation curable ink on a substrate;

partially curing the underside of the ink by irradiating a side of the substrate opposite that of a printed face of the substrate; and substantially fully curing the ink by irradiating a side of the substrate that is the same as the printed face of the substrate wherein the ink printing device is an offset printing press.

11. The process of claim 10, wherein the partial curing occurs immediately after the depositing radiation curable ink.

12. The process of claim 10, wherein the substantially full curing occurs simultaneous with the partial curing.

13. The process of claim 10, wherein the substantially full curing occurs subsequently after the partial curing.

14. The process of claim 10, wherein the substrate can be porous or non-porous.

15. The process of claim 10, wherein the substrate is porous.

16. The process of claim 10, wherein the substrate is wholly or partially transparent.

17. The process of claim 10, wherein the level of the radiation in used in the partial curing can be manually or automatically changed.

* * * * *